US005873670A

United States Patent [19]

Spivey et al.

[11] Patent Number: 5,873,670

[45] Date of Patent: Feb. 23, 1999

[54] CAKE COSMETIC APPLICATOR

[75] Inventors: James R. Spivey, Irvine, Calif.; William F. Brice, Feeding Hills, Mass.

[73] Assignee: Spiveco, Inc., Anaheim, Calif.

[21] Appl. No.: 733,543

[22] Filed: Oct. 18, 1996

Related U.S. Application Data

[63] Continuation of Ser. No. 516,915, Aug. 18, 1995, abandoned.

[51] Int. Cl.[6] ..... A45D 40/00

[52] U.S. Cl. ..... 401/126; 401/123; 401/125; 401/130; 132/298

[58] Field of Search ..... 132/298, 299, 132/307, 290; 401/130, 123, 126, 119, 125

[56] References Cited

U.S. PATENT DOCUMENTS

| | | | |
|---|---|---|---|
| 1,362,808 | 12/1920 | McFarland | 401/130 |
| 1,572,562 | 2/1926 | Schuelke et al. | 132/298 |
| 1,835,249 | 12/1931 | Vicki | 132/298 |
| 2,245,906 | 6/1941 | Deakers et al. | 401/126 |
| 4,828,419 | 5/1989 | Porter et al. . | |
| 4,880,326 | 11/1989 | Spivey et al. . | |
| 4,978,562 | 12/1990 | Spivey et al. . | |
| 4,997,300 | 3/1991 | Spivey et al. . | |

*Primary Examiner*—Steven A. Bratlie
*Attorney, Agent, or Firm*—Frank J. Uxa

[57] ABSTRACT

New dispensers for cake cosmetic products are disclosed. In one embodiment, the dispenser includes a cover member defining a compartment; a cosmetic in the compartment; an abrader member at least partially in the compartment, effective to abrade the cosmetic in the compartment and defining at least one hole through which abraded cosmetic from the compartment passes; and an applicator member including an applicator tip for cosmetic application purposes which is adapted to be placed in proximity to the abrader member to at least partially coat the applicator tip with abraded cosmetic from the compartment.

19 Claims, 2 Drawing Sheets

CAKE COSMETIC APPLICATOR

This is a continuation of application Ser. No. 08/516,915, filed Aug. 18, 1995 now abandoned.

BACKGROUND OF THE INVENTION

The present invention relates to cosmetic dispensers. More particularly, the invention relates to dispensers for cosmetics which are substantially non-flowable and preferably are located in the dispenser in the form of a cake of cosmetic material.

Various applicator systems have been employed to dispense cosmetics. One such applicator is that disclosed in Porter et al U.S. Pat. No. 4,828,419. This patent discloses an applicator in which a cake makeup or cosmetic product is pressed into a metal godet which, in turn, is placed into a metal protector or cover with a spring at the bottom and is held inside by a retaining ring. A handle assembly, which consists of a handle and a porous rubber applicator tip, is then placed into the protector until the nibs on the handle's joinder snap into the ring of the protector.

In use, the porous rubber applicator tip itself is pressed onto the caked product in the godet while the spring acts to urge the product toward the tip. The handle is then twisted or rotated relative to the godet which rubs the rubber tip against the cosmetic product thus transferring the product onto the tip. The handle is then removed and the cosmetic product is applied, as desired.

The applicator of the dispenser in the Porter et al patent is somewhat complex mechanically, for example, requiring a spring which acts to move the cosmetic cake in response to the applicator tip being inserted into and removed from the godet. Also, the porous rubber applicator tip may be subjected to substantial wear because it comes in direct contact with the cosmetic cake and rubs against the cosmetic cake. This wear can result in the applicator tip being mis-shaped or damaged and, thus, less effective for the application of the cosmetic.

It would be advantageous to provide a cosmetic dispenser which avoids one or more of these concerns.

SUMMARY OF THE INVENTION

New cosmetic dispensers have been discovered. The present systems provide for an abrader element or palette which acts to abrade the cosmetic product, thus avoiding undue wear and tear on the applicator tip. Since the applicator tip is not worn by abrading the cosmetic product, it retains its shape for a longer period of time and, thus, is able to precisely apply the cosmetic product, as desired. In addition, the cosmetic product is preferably stationary in the godet so that there is no need for a spring or other biasing device to urge the cosmetic product toward the applicator tip. The present dispensers preferably include a cover member which is at least partially transparent so that the user can quickly and accurately determine how much cosmetic product is remaining in the dispenser system. The present cosmetic dispensers are straightforward in construction and are relatively easy to produce.

In one broad aspect of the present invention, a dispenser is provided which includes a cover member, a cosmetic, an abrader element, and an applicator member. The cover member defines a compartment, and the cosmetic is located in the compartment. The abrader element is at least partially in the compartment and is effective to abrade cosmetic in the compartment. Further, the abrader element defines at least one hole, preferably a plurality of holes, through which abraded cosmetic from the compartment passes. The applicator member includes an applicator tip for cosmetic application purposes which is adapted to be placed in proximity to the abrader element to at least partially coat the applicator tip with abraded cosmetic from the compartment.

At least a portion of the cover member, preferably the godet, is transparent, for example, so that the amount of cosmetic remaining the compartment at any time can be visually determined. In a particularly useful embodiment, the cover member includes an interior wall which partially defines the compartment and a cap member, more preferably made of metal, which covers the interior wall. No spring or other biasing member is located in this preferred cover member arrangement. The metal cap member provides an aesthetically pleasing appearance and, in addition, provides some protection in the event the dispenser is dropped or otherwise mishandled. More preferably, the cosmetic in the compartment is in the form of a cosmetic cake, for example, which is substantially non-flowable or non-extrudable. Still more preferably, the cosmetic is stationary in the compartment, that is is stationary relative to at least a portion of the cover member, in particular relative to the godet.

The cover member and abrader member are preferably coupled together and are structured to allow limited relative axial movement, for example, limited axial movement of the abrader element in the compartment defined by the cover member. In one useful embodiment, the cover member includes an open end and a closed end and a raised element positioned to prevent the abrader element from separating from the cover member through the open end. Thus, the abrader element preferably remains coupled to the cover member. In a very useful embodiment, the raised element is included in a locking ring which is coupled to the godet.

A first coupling element is preferably provided. This first coupling element may be considered a part of the cover member or as a separate component of the dispenser which is coupled to the cover member. The applicator member includes a handle on which is located a second coupling element. These first and second coupling elements are adapted to cooperate to couple the applicator member and the cover member. In a very useful embodiment, the first coupling member is secured to the abrader element and extends outwardly from, and is adapted for limited axial movement relative to at least a portion of the cover member, for example, relative to the godet.

The abrader element preferably includes at least one hole which is configured as an elongated through slot. More preferably, each of the plurality of holes is configured as an elongated through slot. Still more preferably, each of these slots terminates at substantially the same point, for example, at or near the center of the abrader member. Such through hole and slot configurations have been found to be very effective in coating the applicator tip with abraded cosmetic for application purposes. The abrader member is preferably structured to remain in the compartment.

The applicator tip of the applicator member is preferably adapted to be received in the compartment. This applicator tip may be made of any suitable material effective to function to apply the abraded cosmetic. A very useful material of construction for the application tip is a foam material, such as a ground closed cell foam (rubber) material.

As used herein, the term "cosmetic" refers to any substance which can be applied using the present system to one or more parts of a human's body for medicinal or beauty purposes. The present cosmetic is preferably substantially non-flowable or non-extrudable and, more preferably, is present in the compartment as a solid cake. Of course, the presently useful cosmetic should be abradable by the abrader member. Examples of useful cosmetics include lipstick, lip balm, eye makeup, sunscreens, tanning preparations and the like. The present dispenser is especially useful in dispensing eye makeup and rouge.

These and other aspects and advantages of the present invention are set forth in the following detailed description and claims, particularly when considered in conjunction with the accompanying drawings in which like parts bear like reference numerals.

DETAILED DESCRIPTION OF THE PREFERRED EMBODIMENT

Figure 1:
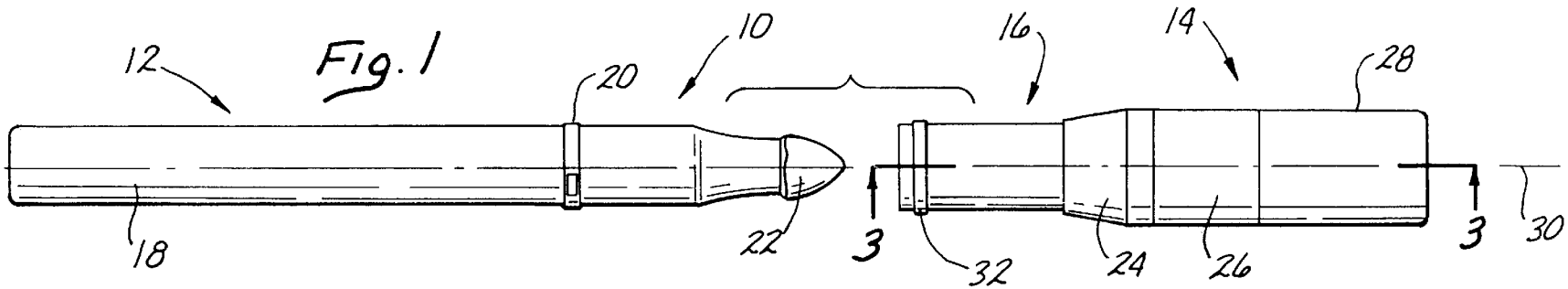
FIG. 1 is a plan view of a dispenser in accordance with the present invention in which the applicator member is separated from the cover member.

Referring now to the drawings, a cosmetic dispensing system of the present invention, shown generally at 10, includes an applicator assembly 12, a cover assembly 14 and a coupling assembly 16. Applicator assembly 12 includes handle 18, raised coupling element 20 and applicator tip 22. Cover assembly 14 includes lock ring 24, transparent godet 26 and metal cap 28.

Figure 2:
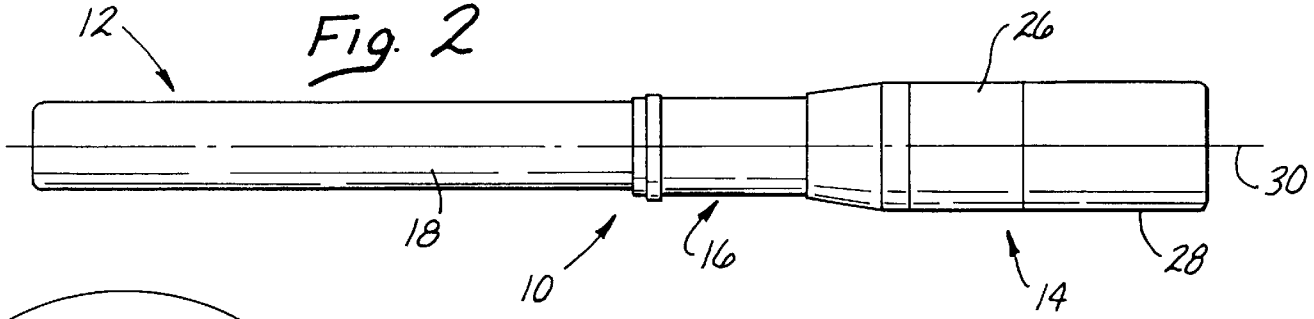
FIG. 2 is a plan view of the dispenser shown in FIG. 1 with the applicator member coupled to the cover member.

In FIG. 1, applicator assembly 12 is shown separated or decoupled from cover assembly 14 and coupling assembly 16. Coupling assembly 16 is coupled to cover assembly 14 and remains so whether dispensing system 10 is in use or is being stored. FIG. 2 shows applicator assembly 12 coupled to cover assembly 14 and coupling assembly 16 along longitudinal axis 30. This coupling occurs as follows. A snap ring assembly including raised element 20 on applicator assembly 12 and an annular groove 32 on coupling assembly 16 are sized and adapted so that when the applicator assembly is placed in the coupling assembly and moved toward the cap 28, raised element 20 snaps into groove 32. In this manner, applicator assembly 12 is temporarily locked or coupled to coupling assembly 16.

Raised element 20 can be part of a plastic insert that is press-fit between two barrel sections. Raised element 20 has an outer dimension slightly greater than the outer dimension of the applicator handle 18. This feature of the present system is similar to a corresponding feature set forth in Porter et al U.S. Pat. No. 4,828,419, the disclosure of which is incorporated in its entirety by reference herein. This coupling of applicator assembly 12 to coupling assembly 16 can be overcome by manually pulling the applicator assembly away from the coupling assembly.

Figure 3:
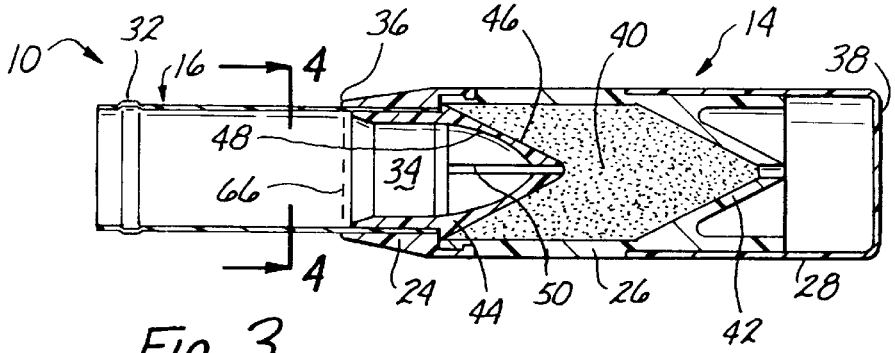
FIG. 3 is a section view taken generally along line 3—3 of FIG. 1.

FIG. 3 provides a more detailed view of the cover assembly 14 and coupling assembly 16. As noted previously, cover assembly 14 includes locking ring 24, godet 26 and cap 28. A compartment 34 extends from the first end 36 of locking ring 24 to the end wall 38 of cap 28. A cake of cosmetic product 40 is located in godet 26 which, in turn is located in compartment 34. An interior wall 42 is also part of godet 26 and defines a portion of the space in which cosmetic product 40 is located. Godet 26 is made of transparent polymeric material, such as polycarbonate. The transparency of godet allows the user of dispensing system 10 to visually monitor/determine the amount of cosmetic product 40 remaining in the godet at any time.

Figure 5:
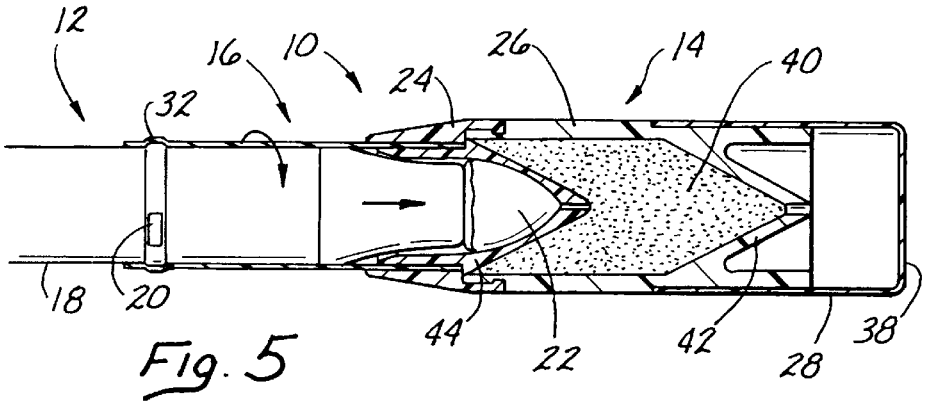
FIG. 5 is a partial plan view, partly in section, of the dispenser shown in FIG. 1 showing the applicator member coupled to the cover member with the applicator member being rotated and substantially all the cosmetic present in the cover member.

An additional component of dispensing system 10 shown in FIG. 3 is palette (abrader) assembly 44. Palette assembly 44 is located in compartment 34 and extends toward cosmetic product 40. The outer surface 46 of palette assembly 44 substantially complements the surface of the cosmetic product 40 which is immediately subject to being abraded. The inner surface 48 of palette assembly 44 at least in general complements the shape of applicator tip 22. Thus, when applicator assembly 12 is coupled to coupling assembly 16, applicator tip 22 is in proximity to or in contact with palette assembly 44, for example, as shown in FIG. 5. Palette assembly 44 is preferably made of a rigid polymeric material, such as polycarbonate.

Figure 4:
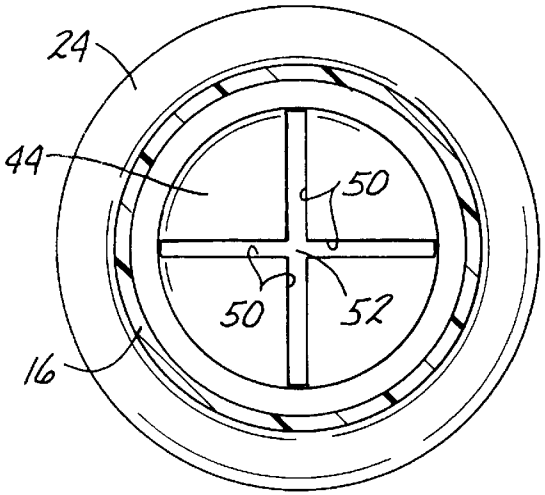
FIG. 4 is a view, partly in section, taken generally along line 4—4 of FIG. 3.

With reference now to FIG. 4, palette assembly 44 includes four elongated through slots 50 which extend from the outer periphery of the palette assembly to the center of the palette assembly and terminate at a common central point 52. Palette assembly 44 and the through slots 50 are structured so that, as the palette assembly is manually urged toward product cosmetic 40 and rotated relative to godet 26, the palette assembly abrades cosmetic from the cosmetic product and the through slots provide pathways through which the abraded cosmetic can pass, so as to coat applicator tip 22.

Figure 8:
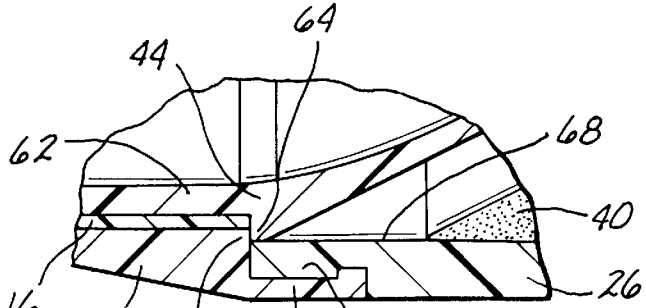
FIG. 8 is a section view taken generally along line 8—8 of FIG. 7.

FIG. 8 identifies in more detail the relationship between various components of dispensing assembly 10. With reference to FIG. 8, locking ring 24, which is preferably made of transparent polymeric material, includes an annular, raised portion 56 and an annularly extending indent 58. Godet 26 includes an annularly extending projection 60 which is sized and adapted to be press-fitted into indent 58 of locking ring 24. In this manner, godet 26 can be secured or coupled to locking ring 24.

Further, again with reference to FIG. 8, coupling assembly 16 is press-fit or otherwise secured to end portion 62 of palette assembly 44. In addition, palette assembly 44 includes an outwardly extending annular portion 64 which has a larger outer diameter than the inner diameter of the raised element 56 of locking ring 24. With this dimensional relationship, palette assembly 44 is restricted from separating from cover assembly 14 through the open end 66 (FIG. 3) of the cover assembly.

The inner sidewall 68 of godet 26 is sized and adapted to allow the palette assembly 44 to move from its initial position, as shown in FIGS. 3 and 5, to a position, when substantially all of the cosmetic product 40 has been abraded, in proximity to, or even in contact with, interior wall 42.

As noted above, coupling assembly 16 is secured to palette assembly 44. Coupling assembly 16 can be moved with palette assembly 44 relative to godet 26, but also is prevented from separating from cover assembly 14.

The combination of cover assembly 14 and coupling assembly 16 can be produced as follows. The locking ring 24 is slipped over the coupling assembly 16. Coupling assembly 16 is preferably made of a metal, for example, anodized aluminum. Palette assembly 44 is then press-fit into the coupling assembly 16. The cover assembly 14 is assembled by press-fitting metal, for example, anodized aluminum, cap 28 over godet 26. The godet 26 is then filled with cosmetic 40 which is pressed to provide a firm, solid cake. The projection 60 of godet 26 is then snapped into the indent 58 of locking ring 24. At this point the cover assembly 14 and coupling assembly 16 are ready for use with applicator assembly 12.

Figure 6:
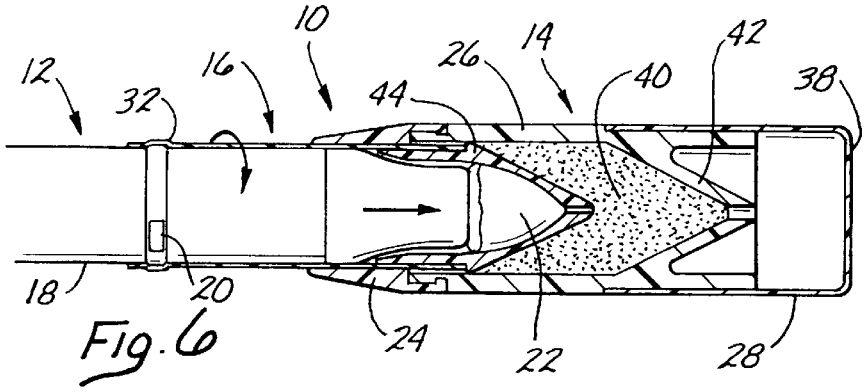
FIG. 6 is a partial plan view, partly in section, of the dispenser shown in FIG. 1 showing the applicator member coupled to the cover member with the applicator member being rotated and with the amount of cosmetic present in the cover member being reduced relative to that shown in FIG. 5.
Figure 7:
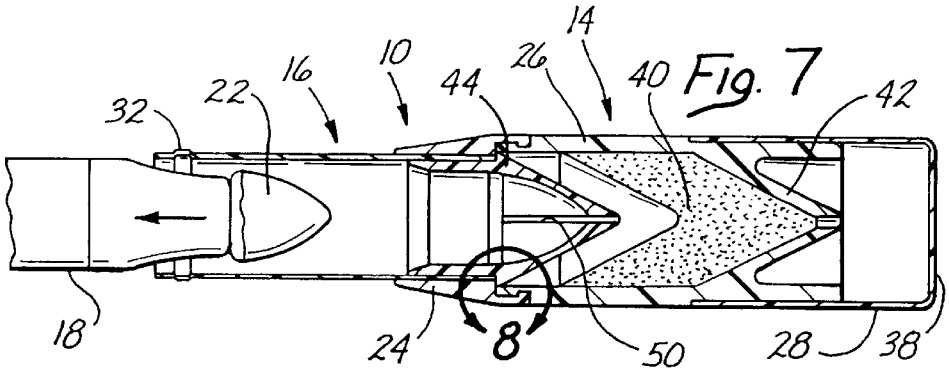
FIG. 7 is a partial plan view, partly in section, of the dispenser shown in FIG. 1 showing the applicator member being removed from the cover member with a coating of cosmetic to be applied.

FIGS. 5, 6 and 7 illustrate the use of dispenser system 10. FIG. 5 illustrates such use with substantially all of the cosmetic product 40 present in godet 26. The applicator assembly 12 is positioned so that applicator tip 22 is in compartment 34 and raised element 20 is coupled to groove 32. At this point, as shown in FIG. 5, the applicator assembly 12 and coupling assembly 16 are urged toward cosmetic product 40 at the same time the coupling assembly is rotated. This action causes palette assembly 44 to come into contact with cosmetic product 40 and to abrade a portion of the cosmetic product. This abraded cosmetic passes through the through slots 50 and coats applicator tip 22. When sufficient abraded cosmetic has been provided to cosmetic tip 22, applicator handle 18 is manually pulled or decoupled from coupling assembly 16 and the applicator tip 22 is used to apply the cosmetic, as desired. One important advantage of dispensing system 10 is that little or no force is applied to applicator tip 22 to rotate palette assembly 44. Such force is applied directly from coupling assembly 16 which is secured to palette assembly 44. The absence of force on applicator tip 22 reduces the risk of mis-shaping or damaging this tip. In other words, applicator tip 22 retains its shape for the entire useful life of system 10 and remains very effective for applying the cosmetic, as desired.

FIGS. 6 and 7 illustrate the use of dispensing system 10 after a portion of the cosmetic product 40 has been abraded away. Again, applicator assembly 12 is coupled to coupling assembly 16 as described above. Applicator assembly 12 is then urged toward the remaining cosmetic product 40 in godet 26. This causes palette assembly 44 to move into contact with the remaining cosmetic product 40. The coupling assembly 16 is rotated, thereby rotating palette assembly 44 and causing abraded cosmetic to pass through slots 50 and coat applicator tip 22. When sufficient abraded cosmetic has been applied to applicator tip 22, applicator assembly 12 is pulled or decoupled from coupling assembly 16. During this pulling, coupling assembly 16 moves away from cover assembly 14 a limited distance until the annular portion 64 of palette assembly 44 comes in contact with raised element 56 of locking ring 24. This is as shown in FIG. 8. At that point, coupling assembly 16 and palette assembly 44 are held by locking ring 24, as described above, so that applicator assembly 12 can be decoupled by further manual pulling of the applicator assembly. This is clearly shown in FIG. 7. After applicator assembly 12 is separated from coupling assembly 16, the applicator tip is used to apply the cosmetic, as desired.

The present cosmetic dispensing system provides substantial advantages, while being relatively straightforward in construction, easy to produce and use. For example, no springs or other biasing members are required to move the cosmetic into contact with the applicator tip. Also, the applicator tip itself is not used to abrade the cosmetic. This reduces the wear and tear on the applicator tip so that the tip remains in tact for a longer period of time to allow precise application of the cosmetic. Also, because the godet is preferably transparent, the user can determine how much cosmetic is remaining at any time during the use cycle of the present system.

While this invention has been described with respect to various specific examples and embodiments, it is to be understood that the invention is not limited thereto and that it can be variously practiced within the scope of the following claims.

What is claimed is:

1. A dispenser comprising:

a cover member defining a compartment;

a non-flowable cosmetic product in the form of a cake in said compartment, said cosmetic product being stationary relative to said cover member;

an abrader member coupled to and adapted for increased axial movement relative to said cover member after a portion of said cosmetic product is removed from said compartment, and held in said compartment, effective to abrade cosmetic from said cake of non-flowable cosmetic product in said compartment and defining at least one hole through which abraded cosmetic from said compartment passes; and an applicator member, separate from said abrader member, including an applicator tip for cosmetic application purposes which is adapted to be placed in proximity to said abrader member to at least partially coat said applicator tip with abraded cosmetic from said compartment.

2. The dispenser of claim 1 wherein at least a portion of said cover member is transparent and no biasing member is located in said cover member.

3. The dispenser of claim 1 wherein said cover member includes an interior end wall which partially defines said compartment and a cap member which covers said interior end wall.

4. The dispenser of claim 3 wherein said cap member is made of metal.

5. The dispenser of claim 1 wherein said cover member includes an open end and a closed end and a raised element positioned to prevent said abrader member from separating from said cover member through said open end.

6. The dispenser of claim 1 which further comprises a first coupling element coupled to said cover member, and said applicator member includes a handle which carries said applicator tip and a second coupling element, said first and second coupling elements being adapted to cooperate to couple said applicator member and said cover member.

7. The dispenser of claim 6 wherein said first coupling element is secured to said abrader member and is adapted for limited axial movement relative to said cover member.

8. The dispenser of claim 1 wherein said at least one hole is configured as an elongated through slot.

9. The dispenser of claim 1 wherein said abrader member defines a plurality of holes through which abraded cosmetic from said compartment passes.

10. The dispenser of claim 9 wherein each of said plurality of holes is configured as an elongated through slot.

11. The dispenser of claim 10 wherein each of said elongated slots terminates at substantially the same point.

12. The dispenser of claim 1 wherein said applicator tip is a foam material.

13. A dispenser comprising:

a cover member defining a compartment;

a non-flowable cosmetic product in the form of a cake located in said compartment, said cosmetic product being stationary relative to said cover member;

an abrader member coupled to and adapted for increased axial movement relative to said cover member after a portion of said cosmetic product is removed from said compartment, and held in said compartment, effective to abrade cosmetic from said cake of non-flowable cosmetic product in said compartment and defining a plurality of holes through which abraded cosmetic from said compartment passes;

a first coupling element secured to said abrader member, extending outwardly from said cover member and adapted for limited axial movement relative to said cover member;

an applicator member, separate from said abrader member, including an applicator tip for cosmetic application purposes which is adapted to be placed in proximity to said abrader member to at least partially coat said applicator tip with abraded cosmetic from said compartment and a handle carrying said applicator tip; and a second coupling element secured to said handle and being adapted to cooperate with said first coupling element to couple said applicator member and said cover member.

14. The dispenser of claim 13 wherein said first coupling element is adapted to be rotated relative to said cover member to cause said abrader member to abrade cosmetic from said cake of non-flowable cosmetic product in said compartment.

15. The dispenser of claim 13 wherein at least a portion of said cover member is transparent and no biasing member is located in said cover member.

16. The dispenser of claim 15 wherein said cover member includes an interior end wall which partially defines said compartment and a metal cap member which covers said interior end wall.

17. The dispenser of claim 13 wherein said cover member is adapted to be coupled to said applicator member so that with said cover member coupled to said applicator member said applicator member is rotatable relative to said cover member to cause said abrader member to abrade cosmetic from said cake of non-flowable cosmetic product in said compartment.

18. A dispenser comprising:

a cover member defining a compartment;

a cosmetic product in the form of a cake in said compartment, said cosmetic product being stationary relative to said cover member;

an abrader member coupled to and adapted for increased axial movement relative to said cover member after a portion of said cosmetic product is removed from said compartment, and held in said compartment, effective to abrade cosmetic from said cake of cosmetic product in said compartment and defining a plurality of elongated through slots through which abraded cosmetic from said compartment passes, each of said elongated through slots being terminated at the same point; and an applicator member including an applicator tip for cosmetic application purposes which is adapted to be placed in proximity to said abrader member to at least partially coat said applicator tip with abraded cosmetic from said compartment.

19. The dispenser of claim 18 wherein said each cake of cosmetic product in said compartment is non-flowable.

* * * * *